United States Patent [19]

Langseth

[11] 3,954,059

[45] May 4, 1976

[54] PYROTECHNIC SIGNAL WITH COLLAPSIBLE HANDLE

[75] Inventor: James D. Langseth, Devil's Lake, N. Dak.

[73] Assignee: Olin Corporation, New Haven, Conn.

[22] Filed: Aug. 30, 1974

[21] Appl. No.: 502,255

[52] U.S. Cl. ..... 102/37.8; 102/37.4

[51] Int. Cl.[2] ..... F42B 4/26

[58] Field of Search ..... 102/37.4, 37.8, 65, 102/65.4, 90

[56] References Cited

UNITED STATES PATENTS

| | | | |
|---|---|---|---|
| 2,595,939 | 5/1952 | Griffith | 102/37.8 |
| 2,620,763 | 12/1952 | Smith et al. | 102/37.8 |
| 3,427,973 | 2/1969 | Beers | 102/65 |
| 3,530,795 | 9/1970 | Denis et al. | 102/37.8 |

FOREIGN PATENTS OR APPLICATIONS

| | | | |
|---|---|---|---|
| 280,738 | 12/1930 | Italy | 102/37.8 |
| 729,852 | 5/1955 | United Kingdom | 102/37.4 |

*Primary Examiner*—Verlin R. Pendegrass
*Attorney, Agent, or Firm*—Donald R. Motsko; William W. Jones

[57] ABSTRACT

A pyrotechnic signal such as a flare, smoke signal, or the like, which is provided with a hollow plastic handle into which the pyrotechnic mass is telescopingly received. For storage, the pyrotechnic mass is positioned within the handle and for use the pyrotechnic mass is partially withdrawn from the handle. The handle may be rendered water-tight so that the signal can be used in marine environments and will float on water.

2 Claims, 3 Drawing Figures

PYROTECHNIC SIGNAL WITH COLLAPSIBLE HANDLE

This invention relates to pyrotechnic signals, such as flares, smoke signals, or the like, and more particularly, to such a signal having a hollow plastic handle in which the pyrotechnic mass is telescopingly disposed.

Pyrotechnic signals, such as flares, smoke signals and the like are, of course, well known devices. They are frequently provided with a handle which the user may grasp and from which the pyrotechnic mass protrudes. The provision of such a handle permits the signal to be manually held even as it burns down, and permits one to pick up and move a burning signal which has burned down considerably while minimizing the risk of being burned by the signal.

Pyrotechnic signals are needed for use in both land and marine environments, and should be adequately protected against deterioration since they are usually kept on hand for long periods of time for use only in emergency situations. Due to the nature of pyrotechnic signals, they should also be designed so as to present a minimum hazard of accidental ignition.

The use of pyrotechnic signals in a marine environment, such as on a boat or the like, presents somewhat of a problem when compared to their use on land. Ordinary pyrotechnic signals, if accidentally dropped into water will sink and will be thus lost. The signal of this invention is, however, telescoped in a water-tight handle whenn in its storage configuration or condition. Thus if it is accidentally dropped into the water prior to use, it will float and can be retrieved and still used in the normal manner. The water-tight storage function of the handle also serves to prolong shelf or storage life of the signal in the damp marine environment. This feature is also important in the event that a boat is swamped, in which case the stored signals will float and can easily be picked up and used.

The pyrotechnic signal of this invention is designed to provide for maximum shelf life, safety, is equipped with a handle for ease in use, and will float on water so that it may be used in a marine environment. The signal of this invention is provided with a pyrotechnic mass which will burn to produce light, smoke, or the like, which mass is disposed in telescoping containment within a handle which is preferably made of plastic. A scratch mix holder and a cap are also provided for the signal. When the signal is collapsed for storage, the pyrotechnic mass is telescoped inside of the handle and the cap is mounted on the assembly to provide a moisture tight seal for the handle. Thus the handle serves as a moisture-tight container for the pyrotechnic mass. This arrangement ensures long shelf life for the signal. For use, the pyrotechnic mass is at least partially withdrawn from the handle so as to protrude therefrom for ignition and subsequent burning. Thus the handle also serves as a means whereby the signal may be safely picked up, handled, and moved about.

It is, therefore, an object of this invention to provide a pyrotechnic signal having a pyrotechnic mass which is telescopingly received within a hollow handle and may be extended therefrom for use.

It is a further object of this invention to provide a signal of the character described wherein the handle is formed from plastic and watertight closure means are included to provide a moisture proof package for storing the pyrotechnic mass.

It is yet another object of this invention to provide a signal of the character described wherein a watertight seal is provided between the pyrotechnic mass and the handle when the former is telescoped within the latter whereby the handle will provide a flotation function for the signal.

These and other objects and advantages of the invention will become more readily apparent to those skilled in the art from the following detailed description of an illustrative embodiment of a signal formed in accordance with the invention taken in conjunction with the accompanying drawings, in which:

FIG. 2 is an axial sectional view of the signal of FIG. 1 showing how the pyrotechnic mass is contained within the handle and the handle is sealed so that the pyrotechnic mass is protected against the deleterious effects of moisture and the like.

Figure 2:
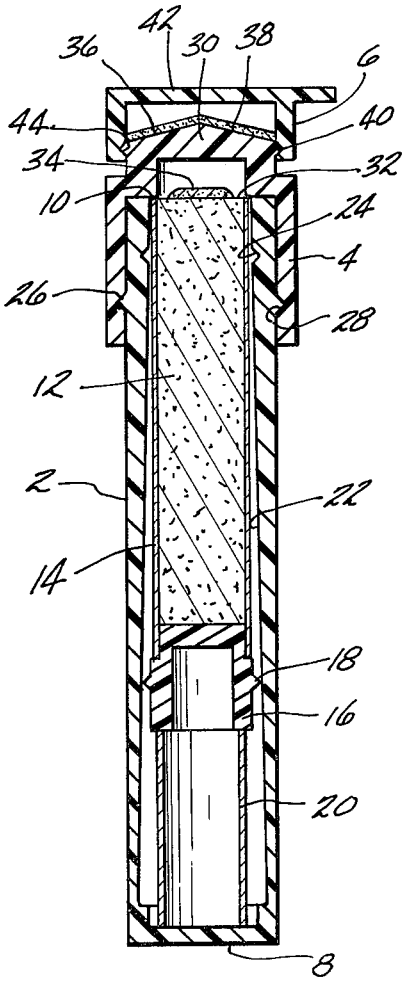

Referring now to the drawings, the signal of this invention includes a handle member 2 preferably of plastic which may be molded, drawn or otherwise formed. A plastic scratch mix holder 4 is attached to the handle 2 and a protective plastic cap 6 is attached to the scratch mix holder 4. The handle 2 is hollow and includes a closed end 8 and an open mouth end 10. A mass of pyrotechnic material 12 disposed in a paper tube 14 is contained inside of the handle 2 in sliding telescoping fashion, as seen in FIG. 2. The pyrotechnic material 12 can be of the type which produces smoke when burned, or which produces light when burned so that the signal can be used as a distress or as a warning signal. The paper tube 14 is secured to a plastic base or holder 16 which is formed with a projecting external rib 18 the purpose of which will be set forth in detail hereinafter. An annular spacer tube 20 may be mounted in the closed end of the handle 2 and may be of a variety of different lengths so that a single length handle can accomodate different lengths of pyrotechnic material. The inside side wall surface 22 of the handle 2 is preferably formed with a taper which expands from a minimum diameter at the mouth end 10 of the handle to a maximum diameter at the closed end 8 of the handle. The tpaered interior side surface of the handle facilitates sliding of the pyrotechhnic mass 12 within the handle 2 so that the former may easily be extended from the latter for use. A recess 24 is formed in the interior side wall 22 of the handle 2 for interlocking engagement with the rib 18 when the pyrotechnic mass 12 is extended from the handle 2. A rib 26 is formed on the outside side wall of the handle 2.

The scratch mix holder 4 is generally cup-shaped and includes an internal recess 28 which receives the handle rib 26 to releasably fix the holder 4 to the handle 2. The holder 4 also includes a transverse wall 30 which is spaced apart from and overlies the end surface 32 of the pyrotechnic mass 12. A button of ignition mix material 34 is deposited on the end surface 32 of the pyrotechnic mass 12. The outer surface 36 of the transverse wall 30 is preferably convexly rounded or conical and has adhered thereto a layer of scratch mix material 38. It will be noted that the transverse wall 30 is interposed between the ignition material 34 and the scratch mix 38 so that the signal cannot be accidently ignited. The holder 4 also includes an external rib 40. The cap 6 is also cup-shaped and includes a transverse wall 42 which is spaced apart from and overlies the scratch mix 38. An internal recess 44 is formed on the cap 6 to receive the holder rib 40 so as to releasably secure the cap 6 to the holder 4.

The handle may be made of any lightweight water-resistant material, with ABS plastic being the preferred material, because of its rigidity and self extinguishing properties. The cap is preferably made of a more flexible material such as low density polyethylene or injection molded rubber. As will be apparent from FIG. 2, when in its collapsed storing configuration or condition, the signal provides inherent protection against moisture and heat for its scratch mix component, and for the pyrotechnic mass and ignition mix button and the entire signal will float if dropped in water.

Figure 1:
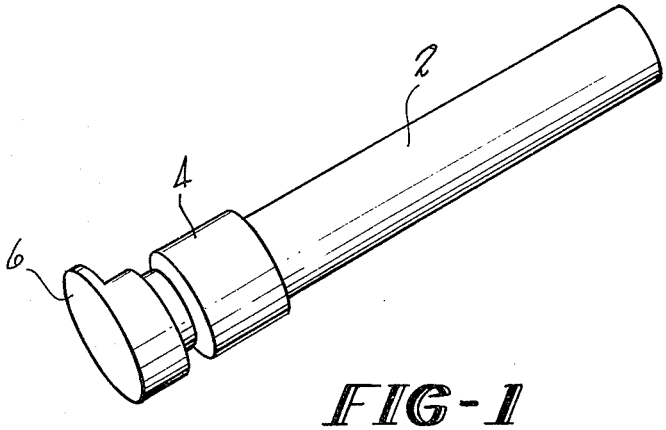
FIG. 1 is a perspective view of one embodiment of a signal made in accordance with this invention.
Figure 3:
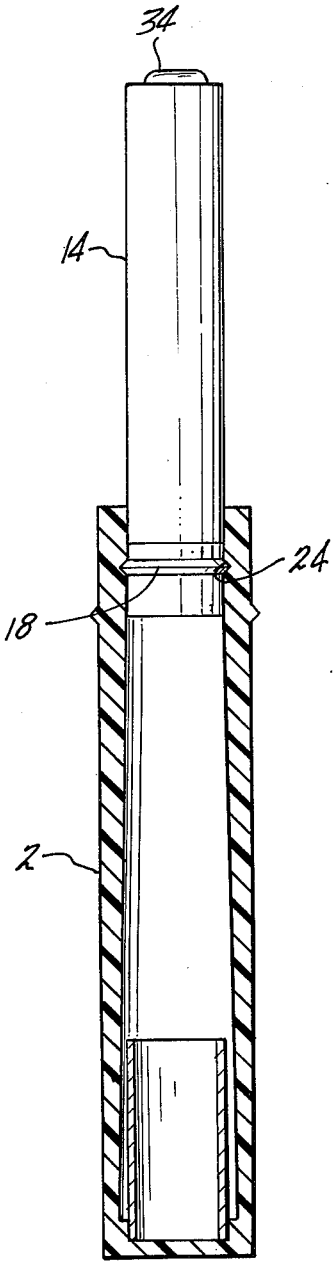
FIG. 3 is an elevated view partly in section of the signal of FIGS. 1 and 2 showing the pyrotechnic mass in its extended position.

FIG. 3 is illustrative of the operating position of the signal. In order to use the signal, one first removes the cap 6 from the scratch mix holder 4, and then removes the scratch mix holder 4 from the handle 2 by manually disrupting the rib and recess connectons between these elements. The signal is then held so that the end surface 32 of the pyrotechnic mass 12 points downwardly. The weight of the pyrotechnic mass 12 combined with the tapered internal side wall 22 of the handle 2 will permit the pyrotechnic mass 12 to slide out of the handle 2 a distance great enough so that the pyrotechnic mass 12 can be grasped manually and pulled further out of the handle until the holder rib 18 is received and held by the handle recess 24. Engagement between the rib 18 and recess 24 will serve to hold the pyrotechnic mass 12 in its extended position, as shown in FIG. 3. The ignition button 34 is then lit by rubbing it with the scratch mix 38, thus igniting the pyrotechnic mass. The signal can then be held in one's hand.

It will be readily appreciated that the signal of this invention provides a compact moisture proof self-contained package for storage, and a floatable storage configuration suitable for use in a marine environment. The use of a plastic handle also permits operating instructions to be printed directly on the handle, which instructions are clearly legible since the handle does not require any waterproofing coating externally thereon.

Since many changes and variations of the disclosed embodiment of the invention may be made without departing from the inventive concept, it is not intended to limit the invention otherwise than as required by the appended claims.

What is claimed is:

1. A hand-held pyrotechnic signal comprising:

a. a handle member formed of resilient plastic and having a cylindrical side wall, a closed end wall unitary and in one piece with said side wall, and an open mouth end;

b. a cylindrical pyrotechnic charge assembly telescopingly received in said handle member, said charge assembly having a bottom end disposed recessed within said handle member, and an ignition end disposed in the area of said open mouth end of said handle member;

c. means in said handle member engaging said pyrotechnic charge assembly to hold said bottom end thereof spaced apart from the closed end wall of said handle member whereby a free space is formed in said handle member;

d. cooperating annular rib and recess retaining means for holding said pyrotechnic charge assembly in an extended position with respect to said handle member when the former is pulled out of the latter, one of said rib and recess being formed on said pyrotechnic charge assembly near the bottom end thereof and the other of said rib and recess being formed on said handle member near the open mouth end thereof; and e. removable closure means forming a water tight cap over said open mouth end of said handle member.

2. The pyrotechnic signal of claim 1, wherein said handle member includes a bore which tapers from a major diameter adjacent said closed end wall to a minor diameter adjacent said open mouth end.

* * * * *